United States Patent [19]

Brügger

[11] 4,150,709

[45] Apr. 24, 1979

[54] PROCESS FOR APPLYING A COATING TO A CENTRIFUGAL CASTING MOLD

[76] Inventor: Gottfried Brügger, Werksgelände 5, A-5503 Mitterberghutten, Austria

[21] Appl. No.: 711,503

[22] Filed: Aug. 3, 1976

[51] Int. Cl.[2] ..... B22D 13/10

[52] U.S. Cl. ..... 164/72; 164/33; 164/114; 164/138

[58] Field of Search ..... 164/33, 72, 114, 138, 164/286; 106/38.27, 38.22; 427/135; 249/114

[56] References Cited

U.S. PATENT DOCUMENTS

| | | | |
|---|---|---|---|
| 2,169,384 | 8/1939 | Hall | 106/38.27 X |
| 2,399,606 | 4/1946 | Schuh et al. | 164/72 |
| 3,437,131 | 4/1969 | Ornitz | 164/33 X |
| 3,445,250 | 5/1969 | Preece | 106/38.27 X |

FOREIGN PATENT DOCUMENTS 1027534 6/1952 France.

*Primary Examiner*—Robert Louis Spruill
*Assistant Examiner*—Gus T. Hampilos
*Attorney, Agent, or Firm*—Salter & Michaelson

[57] ABSTRACT

A process for applying a coating to a centrifugal casting mold for casting copper or alloys thereof in which prior to introducing the molten metal into the mold, an aqueous suspension of powdery material is introduced into the mold and applied on the internal surface thereof in the form of a thin layer. The constituent components of the suspension are zirconium oxide ($ZrO_2$) and an inorganic binder material, preferably non-sintered alumina ($Al_2O_3$), so that a heat-conductive and gas-permeable layer is formed on the surface of the mold.

3 Claims, No Drawings

PROCESS FOR APPLYING A COATING TO A CENTRIFUGAL CASTING MOLD

FIELD OF THE INVENTION

The present invention relates to a process for applying a coating to a centrifugal casting mold for casting copper or alloys thereof, wherein, prior to introducing the molten metal into the mold, a suspension of powdery material is introduced in the form of a thin layer.

BACKGROUND

Tubular bodies produced by a centrifugal casting process and consisting of copper or alloys thereof, particularly of bronze, and used as a raw material for the production of bushings, rings and other shaped bodies suffer from the draw-back that the outer zone and the inner zone are different in structure from the remaining zone of the casting. The outer zone has gas inclusions over a considerable thickness to such an extent that this outer zone is unsuitable and must be removed on a lathe. The inner layer is porous and contains oxides and the thickness of the inner layer primarily depends on the cooling speed of the melt and the rapidity, respectively, of transition from the liquid state into the solid state. Up till now, in centrifugal casting processes for copper and copper alloys, particularly bronze, the centrifugal casting mold additionally had to be relatively slowly filled and sometimes also non-uniformly filled for the purpose of avoiding so-called pin-holes, but this has as a consequence inexact dimensions at the inner side of the casting and non-uniform temperature stress of the mold. A further consequence is increased material consumption and a rapid mold wear. Furthermore, the structure and the technical properties of the casting frequently are strongly different, what in most cases cannot be tolerated. Furthermore, the mold must be kept at a relatively high temperature for limiting gas evolution at the area of the inner wall of the mold.

SUMMARY OF THE INVENTION

It is an object of the invention to avoid the mentioned drawbacks. It is a further object of the invention to improve a process of the kind described above such that the casting operation can be accelerated with low expenditure. It is another object of the invention to substantially improve the quality of the tubular bodies obtained. It is still another object of the invention that the mold used have an extended lifetime.

In a process of the kind described above, these objects of the invention are essentially achieved by using, for the purpose of providing a heat-conductive and a gas-permeable layer, as powdery materials for the suspension the constituting components zirconium oxide ($ZrO_2$) and an inorganic binder material. The inorganic binder material preferably consists of non-sintered aluminium-oxide ($Al_2O_3$). This layer forms a protective layer which does, even under the heat influence of the molten metal, not produce gases in a substantial amount but which is capable of venting the gases in longitudinal direction of the mold wall, which are set free on cooling the melt, and which is, in view of its good heat conductivity, capable of rapidly cooling the melt for attaining a fine structure of the casting. It has been found that such rapid heat removal provides the advantage that during the casting operation a solid metal layer, restricting any gas evolution at the outer zone of the casting, is rapidly formed. On further cooling of the casting, any evolved gases are thus prevented from escaping through the metal in inward direction and from disturbing the formation of a uniform structure of the casting, so that the so-called pin-holes can be avoided in an efficient manner.

In view of the quality of the casting being substantially improved when working according to the inventive process, particularly in view of achieving a substantially uniform structure of the casting, the oversize of the casting required for machining the casting can be reduced to a minimum, for example to only 1 mm at the outer side of the casting. In view of the mentioned rapid heat removal from the melt, the cooling time for centrifugal castings having a wall thickness below 30 mm is reduced to such an extent that, in contrast to processes known up till now, no substantial oxide formation can take place at the inner surface of the casting. This allows restricting the oversize needed for machining purposes at the inner surface of the casting to 1 mm for castings having a wall thickness up to 15 mm and to 2 to 3 mm for castings having a wall thickness up to 30 mm. In view of the small oversizes required at the outer surface and at the inner surface it is now possible to produce in an economic manner and with a high dimensional accuracy raw centrifugal castings with a wall thickness of at least 9 mm. This outstanding dimensional accuracy of the raw centrifugal castings, which in the inventive process is $\pm 0.2$ mm at the outer surface and $\pm 0.5$ mm at the inner surface, results, based on work on lathes as well as on waste in the form of turnings, in a much more simple and thus also much cheaper production of final products.

Also the technical properties of the raw castings are substantially improved over those of raw castings produced according to known processes. By using a suspension of zirconium oxide as a dressing for the mold, the temperature of the mold can be kept relatively low in view of the properties of the suspension. Because there are no difficulties whatsoever to intensely cool the mold during and after the casting operation by means of water, also the temperature of the inner surface of the mold can be kept relatively low. Under consideration of the low heat insulating effect of the mold dressing formed of the zirconium oxide layer, this results in a particularly rapid solidification of the melt, and, as a consequence of these parametres, the technological properties of the raw castings, above all the tensile strength, the elongation on rupture and the Brinell hardness, are increased, noting that the improvement of these properties amounts up to 20% over the presently valid prescriptions for centrifugal castings (DIN 1705, DIN 1709).

A further substantial advantage of the process according to the invention resides in a substantial increase of the lifetime of the centrifugal mold. This statement particularly applies if the suspension is applied to the preheated mold and if, according to the invention, the melt is, after application of the suspension, introduced into the mold over its whole length simultaneously. This mode of operation does not only allow for more rapid filling of the mold but also allows more uniform filling of the mold, so that the heat influence is essentially uniform over the whole length of the mold and, therewith, heat tensions and thus also premature ageing and damaging of the mold can be avoided.

It is known (DT OS 2 343 174) to use for containers for molten metal, refractory materials whose chemical constituents consist of $SiO_2$, $Al_2O_3$, $ZrO_2$ and sodium silicate, noting that the content in sodium silicate is kept within the range of approximately 3 and approximately 10 percent by weight. Thereby it is intended to obtain thixotropic properties, noting that the refractory material is brought into a liquid state under the influence of vibrations in spite of the low water content of the refractory material. Irrespective of the difficulties which are encountered if one tries to apply such a material in form of a layer to the wall of a container, a heat insulating layer is obtained because it is intended to keep hot the melt within the container. The low water content and the relatively great particle size of the material used make it impossible to produce a suspension within the spirit of the present invention, particularly when considering that the material used according to this known process immediately solidifies if it is not subjected to vibrations.

It is also known (FR PS 1 027 534) to clad a refractory centrifugal casting mold used for casting iron or steel, with metal oxides, for example with $Al_2O_3$, which are mixed with nonmetallic constituents. However, there are considerable differences between centrifugal casting of cast iron or steel and centrifugal casting of copper and alloys thereof. Experience has shown that mold claddings known for casting cast iron and steel fail in processes for casting copper and copper alloys, particularly bronze, which might be attributable to the requirements mentioned above. Thus, it is not possible to derive from the above-mentioned known claddings, irrespective of such claddings serving as transport containers or for centrifugal casting molds for casting cast iron or steel, anything which might be suitable for centrifugal casting of copper and copper alloys.

According to a preferred embodiment of the invention, the mold is, during introducing the suspension, rotated around its axis with a lower speed of revolution than during introducing the melt. The reason therefor being that the suspension can be most easily distributed over the inner surface of the mold at a relatively low speed of revolution of the mold, whereas it is desirable to work in the medium range of speeds of revolution when charging the mold with the molten metal. Until the moment of complete distribution of the melt within the mold, a nonuniform distribution of centrifugal forces can be observed which can be kept within a tolerable range at medium speeds of revolution.

As already mentioned, the heat conductivity of the layer used in a process according to the invention can be further increased by selecting the thickness of this layer correspondingly small, particularly within the range between approximately 0.1 and 0.3 mm, which is substantially smaller than in known processes. It is convenient to aim at a thickness of the layer within quite narrow limits. For this reason it is not to recommend to apply the layer to the mold by means of a brush, as is frequently the case in known processes, but it is to recommend to rotate the mold during the introduction of the suspension as has been described above.

The suspension used is preferrably an aequous suspension, and the preferred inorganic binder material used is extremely finely elutriated alumina ($Al_2O_3$).

DESCRIPTION OF PREFERRED EMBODIMENT

EXAMPLE:

This example illustrates the production of a raw casting in a centrifugal casting process having an outer diameter of 162 mm and an inner diameter of 138 mm and a length of 660 mm and from which a friction bearing is to be produced which has an outer diameter of 160 mm and an inner diameter of 140 mm. The bronze used meets the standards according to DIN 1705, melt composition Gz-Rg 7. The steel mold, which is supported in horizontal position, is preheated to approximately 150° C., and covered at its inner surface, while being slowly rotated with 300 revolutions per minute, by means of an aqueous suspension containing zirconium oxide and extremely finely elutriated alumina as a binder, until a layer of a thickness of approximately 0.2 mm is obtained. After closing the mold, the means for introducing the molten metal is being centrally applied. The spout of the casting funnel is dimensioned in correspondence with the composition of the molten metal and has a diameter of 28 mm. A casting channel extending within the mold over two thirds of the length of the mold in an approximately horizontal position is connected to the casting funnel. With this means for introducing the molten metal, a known weight of the molten metal heated to a temperature above 1150° C. is, with acceleration of the circumferential speed of the inner surface of the mold to 7 m/sec, introduced such that the casting funnel remains filled with molten metal up to a level of approximately 200 mm, whereby a constant flow of the molten metal and an even distribution of the molten metal within the mold by means of the casting channel can be reliably obtained. The casting time lasts only about 4 seconds. Subsequently, the means for casting molten metal is being removed and the mold is being cooled with water, whereupon, after solidification of the raw casting, the raw casting is being removed from the mold.

In view of the small oversize of only 1 mm of the raw casting at its outer side and as well at its inner side, the friction bearing can be finished in one single turning operation.

The following table illustrates the improvement of the technical properties as compared with the properties required according to DIN.

| | According to DIN 1705 for Gz-Rg7 | According to the inventive process |
|---|---|---|
| tensile strength (kp/mm$^2$) | 30 | 32 |
| elongation on rupture (%) | 20 | 25 |
| Brinell hardness (kp/mm$^2$) | 85 | 95 |

The invention is particularly applicable for casting in molds, i.e. repeatedly usable molds and permanent molds, respectively, copper and such copper-containing alloys in which copper is a substantial constituent and major constituent, respectively.

What I claim is:

1. A process for applying a heat-conductive and gas-permeable coating to a centrifugal casting mold for casting copper or alloys thereof and then casting thereover a pin-hole free copper alloy casting, said mold having an internal surface, said process comprising the steps of introducing into the mold, prior to introducing the molten metal into the mold, a suspension of powdery material consisting essentially of zirconium oxide ($ZrO_2$) and an inorganic binder of aluminum oxide ($Al_2O_3$) in fine particle form, applying said material to the interior surface of the mold in the form of a thin smooth layer having a thickness of 0.1–0.3 mm., so that a heat-conductive and gas-permeable layer which is non-gas producing is provided on the internal surface of the centrifugal casting mold and which thin, smooth, heat-conductive and gas-permeable layer is capable of rapidly cooling a molten copper or copper alloy melt cast thereagainst, and thereafter centrifugally casting the molten copper or alloy thereof into said mold to form a pin-hole free casting of good dimensional accuracy.

2. A process as claimed in claim 1, wherein said inorganic binder material is non-sintered $Al_2O_3$.

3. A process as claimed in claim 1, wherein said suspension is an an aequous suspension of finely grained zirconium oxide ($ZrO_2$) and extremely finely elutriated alumina ($Al_2O_3$) applied to said internal surface of the mold.

* * * * *